United States Patent [19]

Cullen

[11] Patent Number: 4,493,605

[45] Date of Patent: Jan. 15, 1985

[54] MATERIAL HANDLING APPARATUS FOR LOADERS

[76] Inventor: Steven R. Cullen, 1167 Harrison, Astoria, Oreg. 97103

[21] Appl. No.: 388,273

[22] Filed: Jun. 14, 1982

[51] Int. Cl.[3] ..... B65G 47/90

[52] U.S. Cl. ..... 414/726; 294/70

[58] Field of Search ..... 414/726, 404, 23, 739; 37/117.5; 294/70

[56] References Cited

U.S. PATENT DOCUMENTS

| | | | |
|---|---|---|---|
| 2,556,592 | 6/1951 | Markkula | 414/726 X |
| 2,890,806 | 6/1959 | Pilch | 294/70 |
| 3,187,916 | 6/1965 | O'Leary | 294/70 |
| 3,252,606 | 5/1966 | Pryor | 414/726 X |
| 3,598,266 | 8/1971 | Fisher | 414/726 X |
| 3,737,059 | 6/1973 | Peterson et al. | 414/726 X |
| 4,047,626 | 9/1977 | Meisel, Jr. | 294/70 |

*Primary Examiner*—Joseph E. Valenza
*Assistant Examiner*—Terrance L. Siemens
*Attorney, Agent, or Firm*—Lee R. Schermerhorn

[57] ABSTRACT

A clamshell-type loader bucket has a pair of jaws with meeting edges that close together on one side of the bucket and on the bottom of the bucket to retain fine material such as sand, dirt or dry grain. The meeting edges on the bottom of the bucket are arranged to pick up such material from a flat supporting surface when the bucket is in vertical position. The bucket has a hopper bottom with inclined bevel plates on the jaws arranged to force material upward in the bucket as the jaws close on the material when the bucket is in vertical position.

9 Claims, 4 Drawing Figures

MATERIAL HANDLING APPARATUS FOR LOADERS

BACKGROUND OF THE INVENTION

This invention relates to material handling apparatus for loaders, more specifically a clamshell-type bucket.

Clamshell-type buckets have long been used for various purposes and for picking up different types of materials, but there is still a need for a general purpose loader bucket for farm use, for example, a loader bucket adapted for mounting on a lifting boom on a tractor.

There is a particular need for a loader bucket capable of picking up the remains of a pile of loose material such as sand, gravel, dirt or dry grain on a flat supporting surface such as a floor or the ground.

SUMMARY OF THE INVENTION

The present clamshell-type loader bucket has a pair of jaws with meeting edges that close together on one side of the bucket and on the bottom of the bucket to retain fine, loose material as mentioned above. The meeting edges on the bottom of the bucket are arranged to pick up such material from a flat, supporting surface when the bucket is in vertical position.

The bucket has a hopper bottom with inclined, flat plates on the jaws arranged to force such fine material upward in the bucket as the jaws close on the material when the bucket is in vertical position. This facilitates getting more material into the bucket in each operation, thereby improving the efficiency of the operation. When the bucket is advanced with the jaws wide open, these plates serve as scrapers for cleaning barn floors and other similar operations. The invention will be better understood and the foregoing and additional objects and advantages will become apparent from the following description of the preferred embodiment illustrated in the accompanying drawings. Various changes may be made in the details of construction and certain features may be used without others. All such modifications within the scope of the appended claims are included in the invention.

DESCRIPTION OF THE PREFERRED EMBODIMENT

Figure 1:
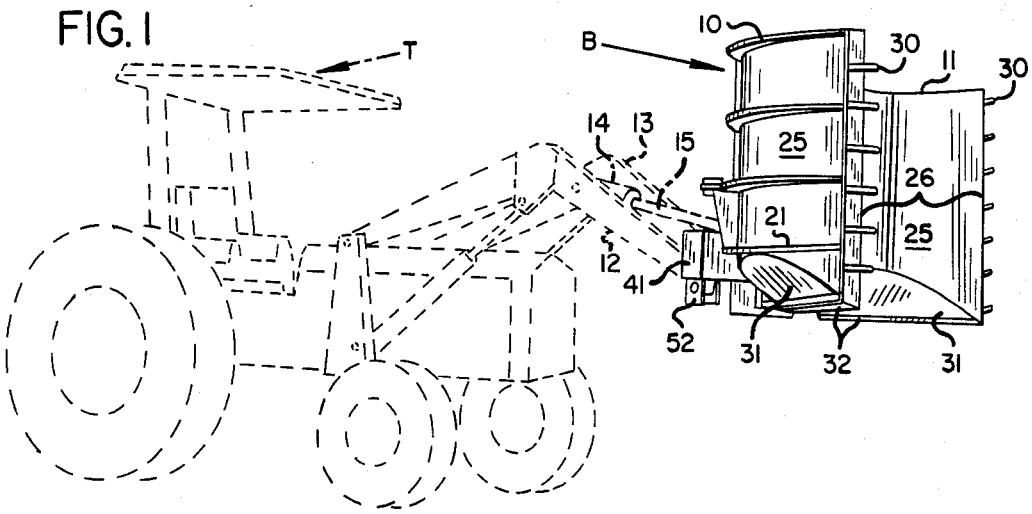
FIG. 1 is a perspective view of a loader bucket embodying the invention mounted on the lifting boom of a farm tractor shown in broken lines.
Figure 2:
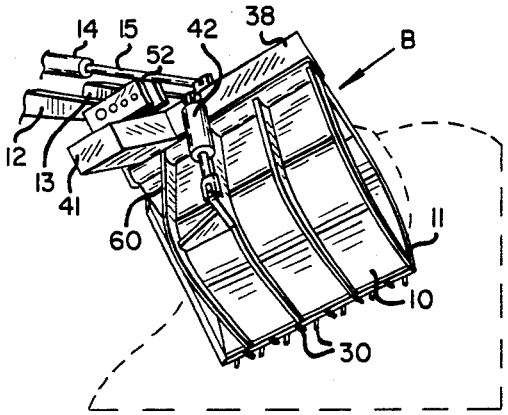
FIG. 2 is a perspective view showing the operation of the bucket in picking up loose material in a pile.
Figure 3:
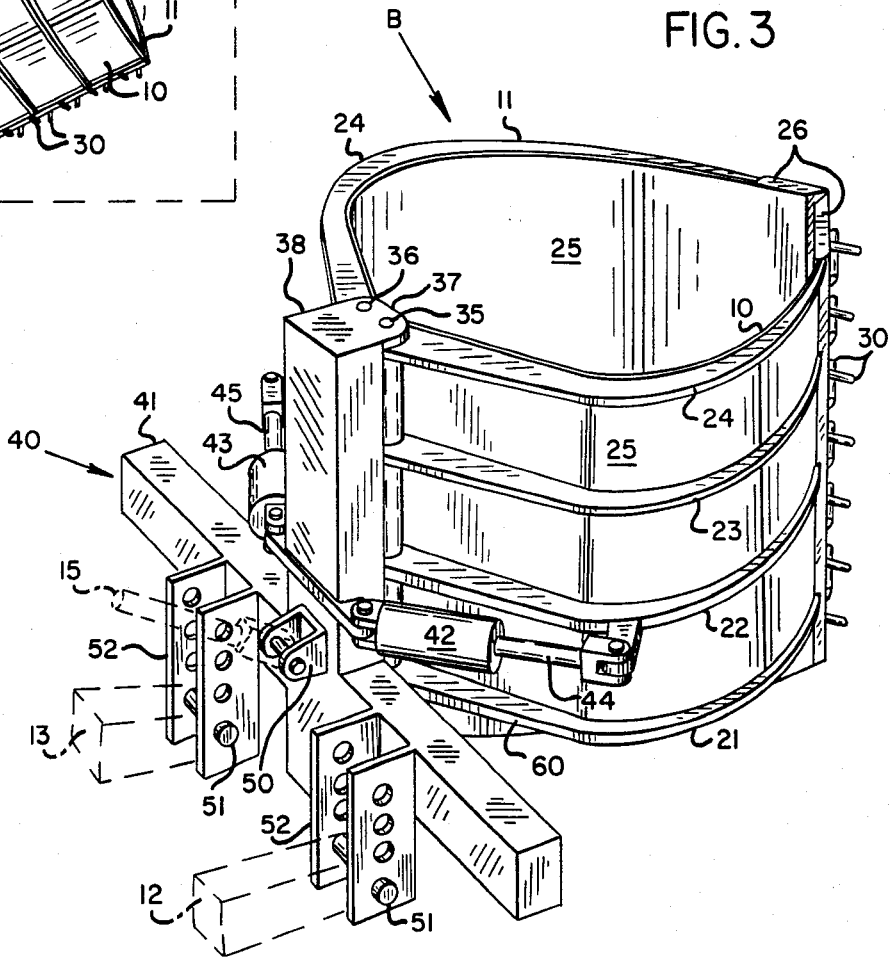
FIG. 3 is a perspective view showing the operating mechanism for the jaws of the bucket.

As shown in FIGS. 1, 2, and 3, the clamshell-type bucket B has a pair of jaws 10 and 11 mounted on the boom tip arms 12 and 13 of a conventional farm tractor T. The lifting boom on the tractor includes a hydraulic cylinder 14 and piston rod 15 for tilting the bucket B forward from the upright, vertical position in FIG. 1 to a horizontal position. The bucket is shown in an intermediate, inclined position in FIG. 2.

Each jaw 10 and 11 of the bucket comprises a plurality of curved ribs 21–24 lined with a metal plate 25 welded to the ribs. The meeting edges of the two jaws on one side of the bucket are provided with flat, metal plates 26 welded to the ribs 21–24 and liner plates 25. When the bucket is closed as shown in FIG. 3, the two plates 26 meet together in a straight line to prevent the escape of fine material from the bucket. Projecting tines or spikes 30 are welded on the outside surfaces of plates 26 in an arrangement to intermesh with each other when the bucket is closed.

The bucket has a hopper bottom formed by two inclined, flat bevel plates 31, one on the lower end of each jaw as best shown in FIG. 1. These bevel plates have horizontal lower edges 32 which are adapted to scrape fine material from a flat, supporting surface when the jaws are closed with the bucket in vertical position. Thus, the two bottom edges 32 come together and meet in a straight line to prevent loss of fine material from the bottom of the bucket when the jaws are closed. The inclination of bevel plates 31 forces loose material upward in the bucket as the jaws close so as to increase the amount of material that is captured in each closing operation of the bucket, thereby increasing the efficiency of the operation.

The rear ends of ribs 21–24 in the jaw 10 are welded to a shaft 35 and the rear ends of the corresponding ribs in the jaw 11 are welded to a shaft 36, these shafts being parallel to the meeting edges 26 of the jaws. The opposite ends of shafts 35 and 36 are mounted for rotation in a pair of bearing plates 37 on the upper and lower ends of the vertical arm 38 of a support frame 40. Support frame 40 also has a transverse horizontal arm 41.

Pivotally mounted on vertical arm 38 are a pair of hydraulic cylinders 42 and 43. Cylinder 42 has a piston rod 44 connected to the second rib 22 in the jaw 10 and cylinder 43 has a piston rod 45 similarly connected to the second rib in the jaw 11. Thus, the two jaws 10 and 11 are adapted to open and close in unison if the jaws encounter equal resistance, or no resistance, to the opening and closing movements.

However, if one jaw encounters substantially more resistance to its closing movement than the other jaw, then the closing movement of the other jaw will continue until it, too, is stopped by some superior resistance or the end of the cylinder stroke. This feature and advantage will be explained in greater detail in connection with FIG. 4.

Piston rod 15 in FIG. 1 is connected to a bracket 50 on the support frame 40 in FIG. 3. The ends of boom tip arms 12 and 13 are connected to pins 51 which may be placed in selected positions in a series of holes in a pair of brackets 52 on the horizontal arm 41 of support frame 40. These connections provide for tilting the bucket forward to any desired angle between vertical and horizontal as previously mentioned. If the tractor is equipped with two tilt cylinders 14, their piston rods are connected to pins in the upper holes in brackets 52 and bracket 50 is not used.

Figure 4:
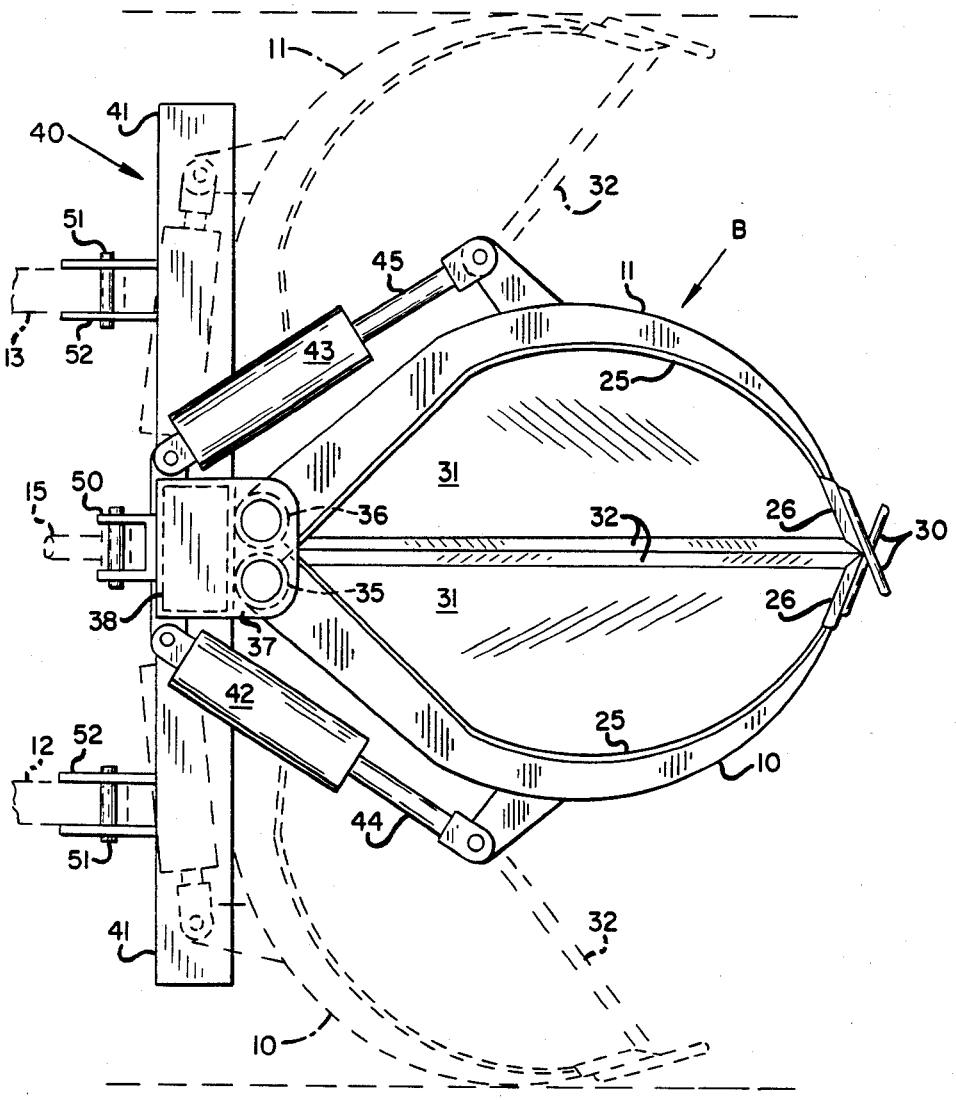
FIG. 4 is a top plan view of the bucket with the open positions of the jaws shown in broken lines.

FIG. 4 shows the range of movement of the bucket jaws between open and closed positions. The plates 26 on the opposite jaws meet together on the forward side of the bucket and the scraping plates 32 on the lower edges of plates 31 meet together at the bottom of the bucket to seal the bucket against loss of fine material. The meeting edges of plates 26 and 32 all lie in a common vertical plane.

When one of the bucket jaws encounters substantially more resistance to its closing movement than the opposite jaw, the latter continues to its closed position in solid lines, its movement being stopped at this point by its piston rod reaching its limit of stroke. The resulting increase in hydraulic pressure then overcomes the resistance encountered by the one jaw and the one jaw completes its closing movement to solid line position.

Although the advantages in handling loose materials such as sand, gravel and dry grain have been emphasized, the present bucket also has important advantages in other types of work where conventional loader buckets cannot be used.

For example, the present bucket is very effective in cleaning barns. With the bucket jaws wide open as shown in broken lines in FIG. 4, the tractor can be advanced with the scraper blades 32 sliding on the floor as a pair of scrapers. Then at the end of the run, the jaws are closed together enclosing all the scraped-up material and carrying it away for disposal in one speedy operation. The bucket is also effective for the more ccnventional purposes such as picking up dirt, straw, hay and other feed materials, either loose or in bales.

In scraping a barn floor the straight rear portions 60 of lower ribs 21 bear against horizontal arm 41 of support frame 40 and are pushed forward thereby to stabilize the bucket jaws when they meet resistance on the floor. Likewise in FIG. 2 the arm 41 bears against ribs 21 to thrust the jaws 10 and 11 into a pile of material when the jaws are in wide open positions.

In picking up material from a pile as shown in FIG. 2, there is no difficulty in getting a full bucket in each operation. When the pile is reduced to a height of a foot or so, the remainder must be gathered by turning the bucket upright and scraping it together with scraper parts 31 and 32 as described above. Then the bevel plates 31 are effective to force the material upward in the bucket as the jaws close together.

Nevertheless in this mode of operation the upper part of the bucket usually remains empty. This would result in bending and twisting of the bucket jaws, separating the meeting edges 26 and 32 in places and allowing fine material to escape, if the closing forces were applied to the bucket jaws at mid height. To minimize such distortion the piston rods 44 and 45 are connected to the second ribs 22, closer to mid height of the contained load in such situations. The intermeshing of tines 30 on the two jaws also tends to reduce distortion when the load is concentrated in one end of the bucket.

Moreover, the same distortion problem exists with very flowable solid materials such as sand, gravel and grain picked up by the bucketfull as in FIG. 2. When the bucket is turned upright, the material exerts much more pressure against the lower portions of the bucket jaws than against the upper portions. Here again, the features described above help to reduce distortion and leakage of material from the bucket.

What is claimed is:

1. A clamshell-type loader bucket adapted for mounting on a lifting boom on a tractor comprising a pair of bucket jaws pivotally mounted on vertical axes on one side of the bucket for opening and closing movements when the bucket is in vertical position, said bucket having an open top and a hopper bottom formed by inclined bevel plates on said jaws extending across the entire area of the bottom of the bucket arranged to force material upward in the bucket as the jaws close on said material, said bevel plates having scraper edges to scrape up said material from a flat supporting surface when the bucket is advanced across said surface in a vertical position by said tractor with said jaws wide open, said scraper edges extending in a horizontal plane across the entire width of said open jaws when the bucket is in said vertical position.

2. A bucket as defined in claim 1 including means for opening and closing said jaws and means for tilting the bucket on said boom between vertical and horizontal positions, said jaws having meeting edges arranged to close together on each other on one side and the bottom of the bucket to retain fine material.

3. A bucket as defined in claim 2, said means for opening and closing said jaws being operative on said jaws at a level about one-third the height of the bucket side walls in the vertical position of the bucket.

4. A bucket as defined in claim 2, said means for opening and closing said jaws being arranged to continue the closing movement of the jaw that meets the least resistance when the other jaw meets excessive resistance to closing.

5. A bucket as defined in claim 4, said means for opening and closing said jaws comprising a separate cylinder and piston for each jaw.

6. A bucket as defined in claim 2 including tines on said jaws arranged to interfit with each other as said meeting edges close together on said one side of the bucket.

7. A bucket as defined in claim 2 including a support frame having a vertical arm and a lateral horizontal arm, pivot shafts for said jaws on said vertical arm, pivotal connections for said jaw opening and closing means on said vertical arm, a pivotal connection for said tilting means on said vertical arm, and pivotal connections with said boom on said horizontal arm.

8. A bucket as defined in claim 7, said bucket jaws bearing against said horizontal arm of said support frame in the wide open positions of said jaws.

9. A bucket as defined in claim 1 including a support frame for said bucket jaws, said jaws in said wide open positions bearing against said support frame to stabilize the jaws in a scraping operation on said surface.

* * * * *